United States Patent [19]

Worthington

[11] Patent Number: 4,576,440

[45] Date of Patent: Mar. 18, 1986

[54] SKYLIGHT WITH A REMOTELY OPERABLE LIGHT INTENSITY REDUCING MECHANISM

[76] Inventor: Mark N. Worthington, 10227 White Mountain Rd., Sun City, Ariz. 85351

[21] Appl. No.: 690,631

[22] Filed: Jan. 11, 1985

[51] Int. Cl.[4] ..... G02B 17/00; G02B 27/00

[52] U.S. Cl. ..... 350/258; 350/263

[58] Field of Search ..... 52/200; 350/258–265

[56] References Cited

U.S. PATENT DOCUMENTS

| | | | |
|---|---|---|---|
| 1,341,259 | 5/1920 | Champeau | 350/263 |
| 3,186,473 | 6/1965 | Myers et al. | 350/258 X |
| 4,428,358 | 1/1984 | Adamson | 350/260 |

*Primary Examiner*—Richard A. Wintercorn

*Attorney, Agent, or Firm*—Herbert E. Haynes, Jr.

[57] ABSTRACT

A skylight structure having a light shaft enclosure is provided with a light intensity reducing translucent panel which is selectively movable from a remote location between a first position wherein full intensity light is allowed to pass through the skylight and a second position wherein the passed light is reduced in intensity.

16 Claims, 8 Drawing Figures

FIG. 1
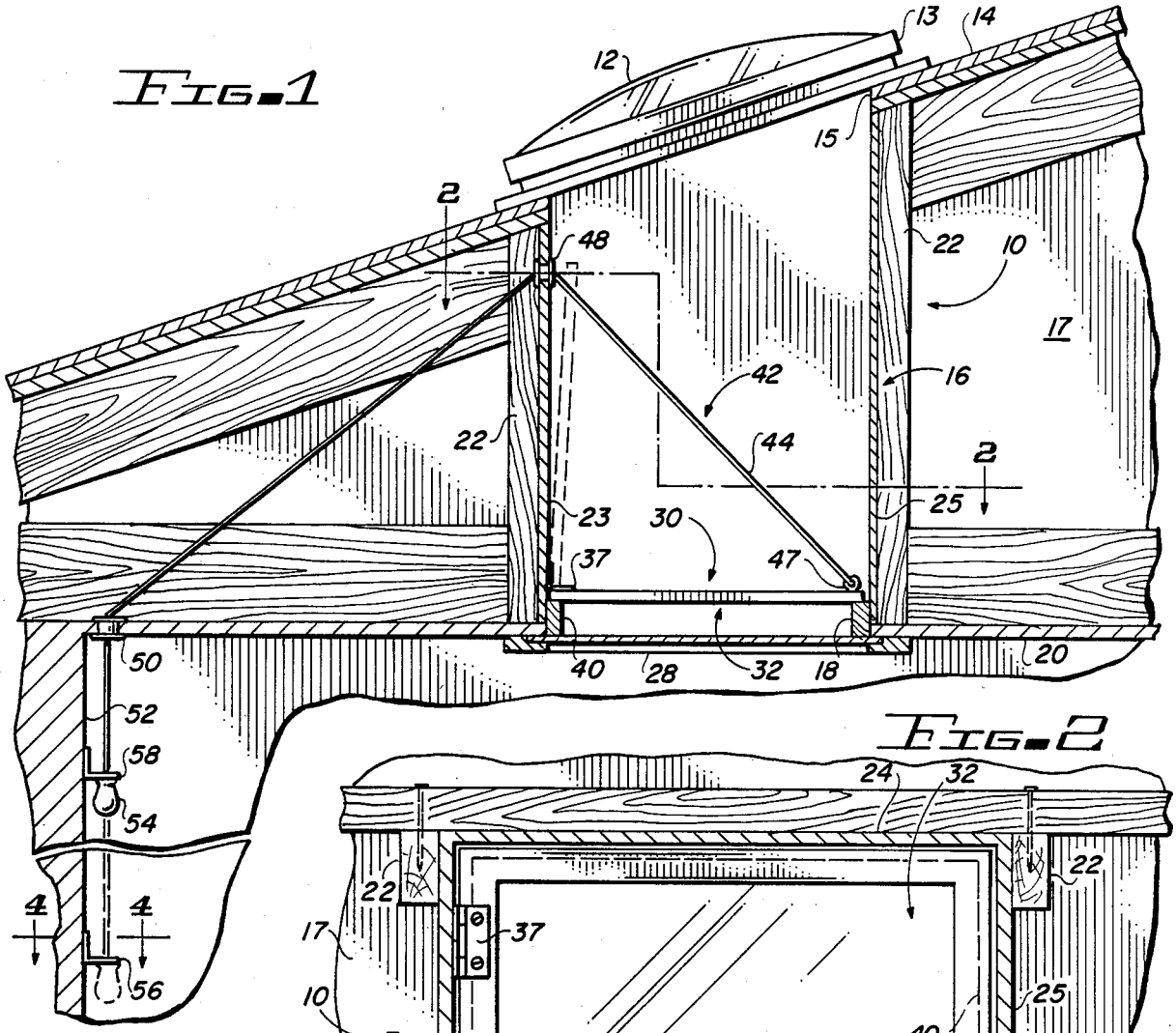
FIG. 2
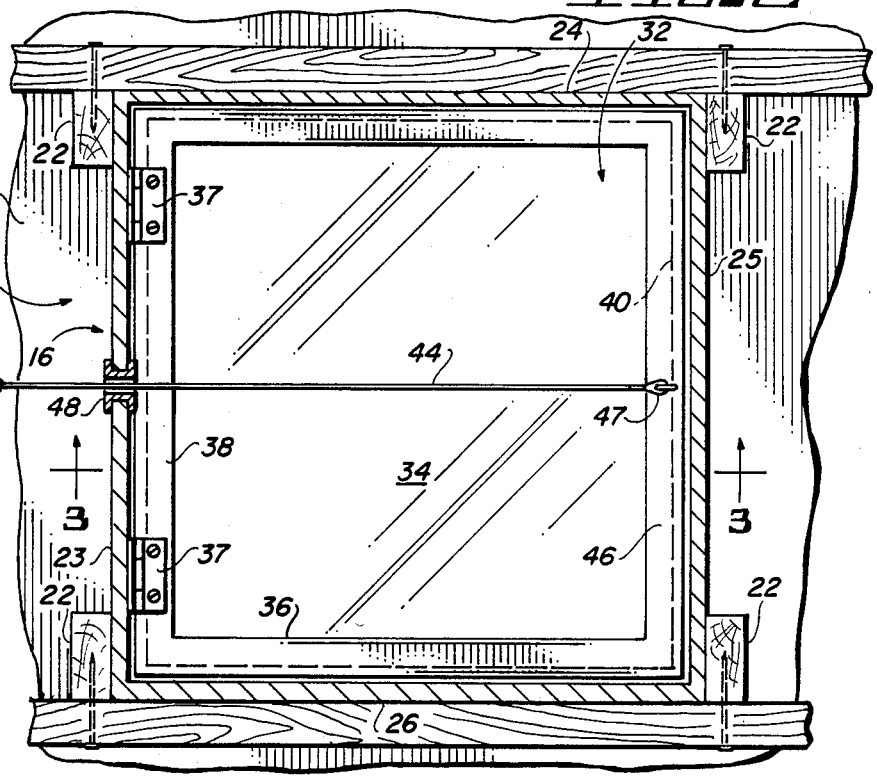
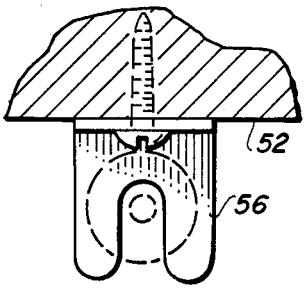
FIG. 4
FIG. 3
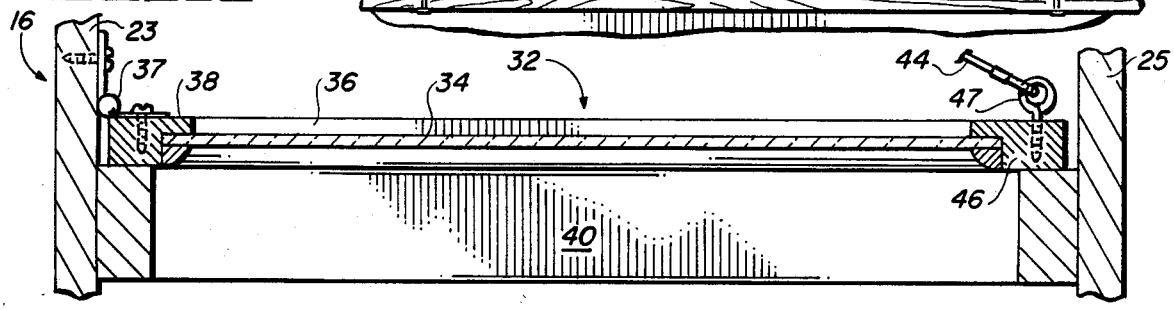

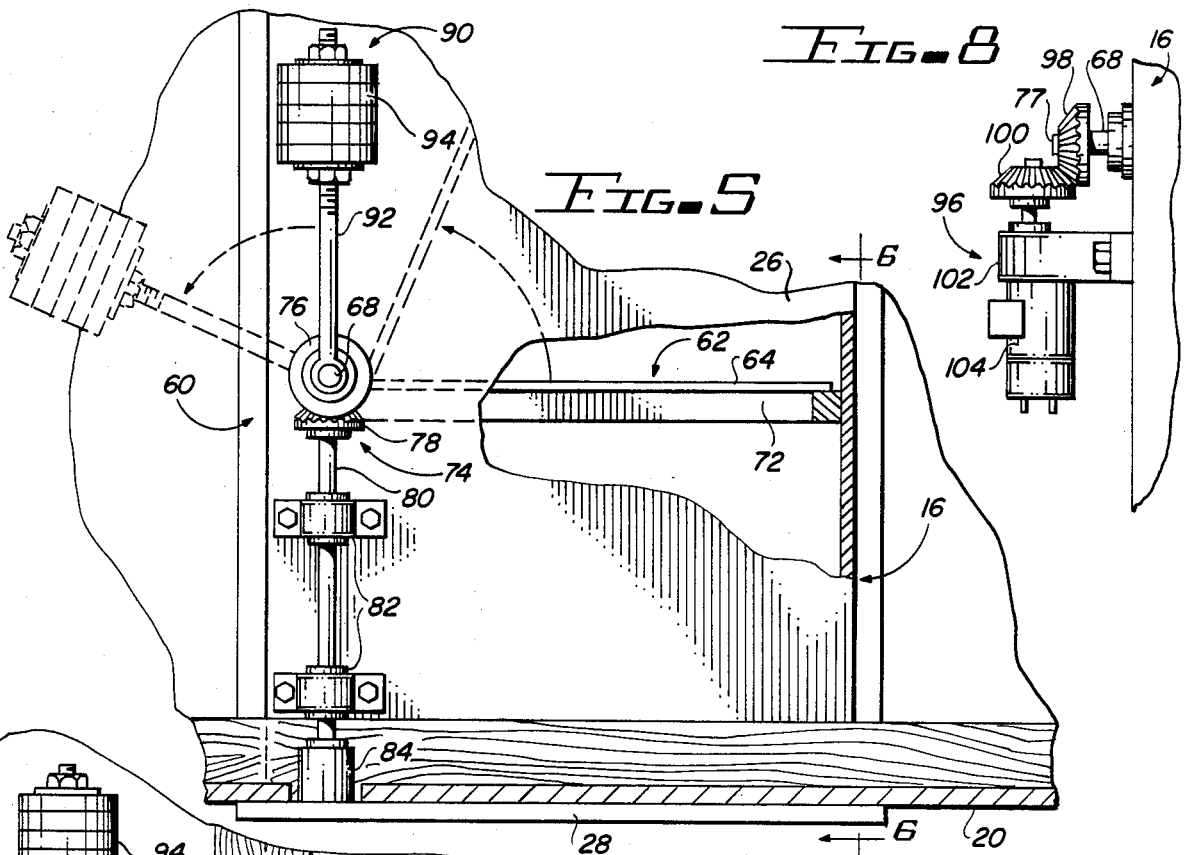
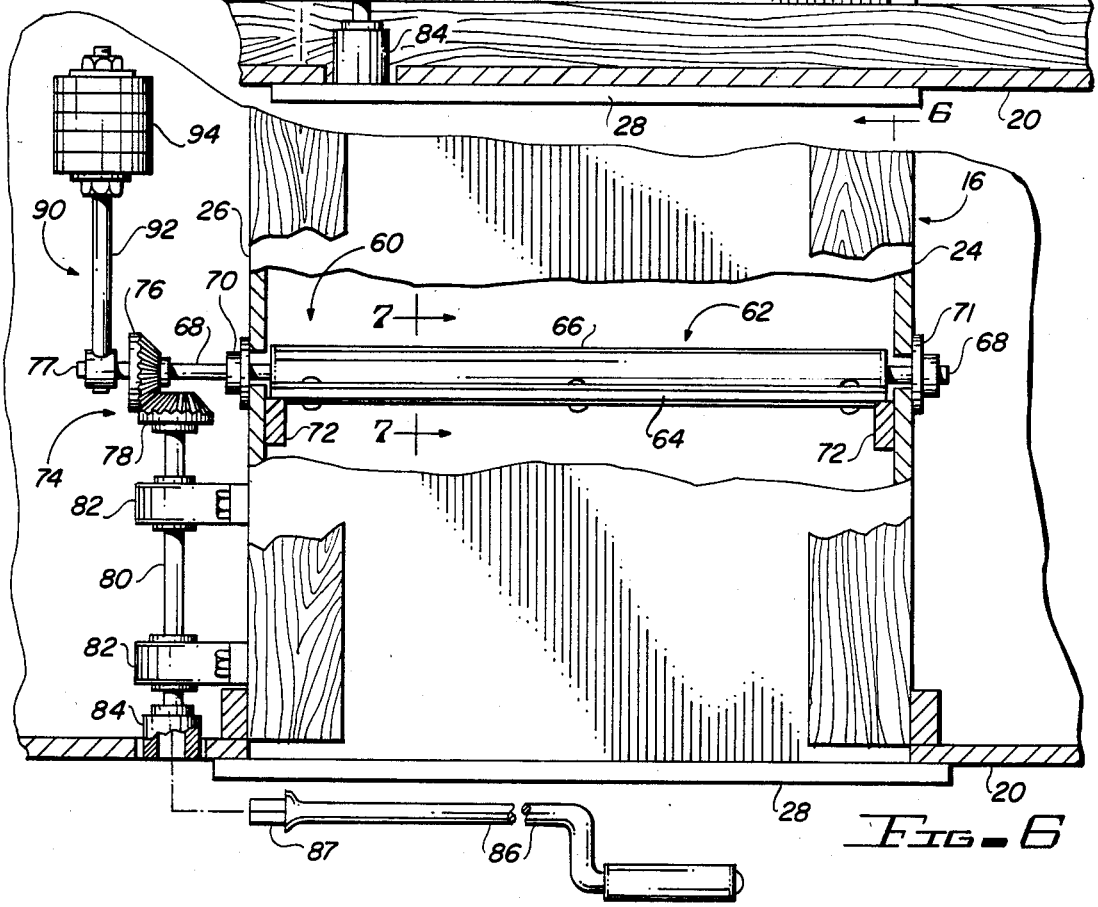
FIG. 6
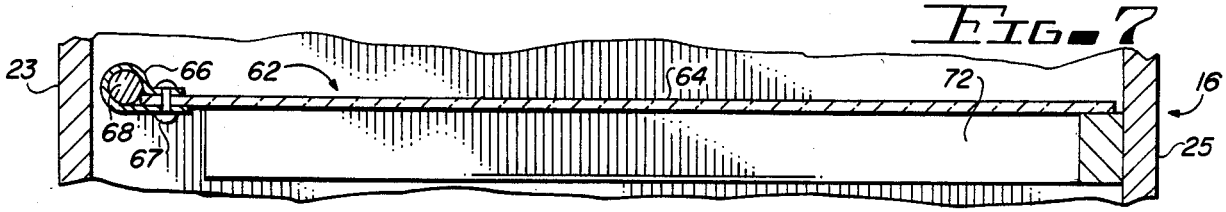

SKYLIGHT WITH A REMOTELY OPERABLE LIGHT INTENSITY REDUCING MECHANISM

BACKGROUND OF THE INVENTION

1. Field of the Invention

This invention relates to skylight structures in general and more particularly to the combination of a skylight structure having a light intensity reducing mechanism for selectively admitting high and lower intensity light.

2. Description of the Prior Art

As is well known, a skylight is a structure formed in the roof of a building for admitting natural light into the building, and such structures have been used for many years. Although skylights differ somewhat in size and configuration, they all have a light admitting window that is carried in a suitable frame which is mounted on the roof of a building in a position above an opening provided in the roof. In modern skylights, the light admitting windows are usually formed of plastic and are molded in a dome shape, and some of them are hingedly mounted for opening to provide ventilation capabilities. Skylights further include a light shaft structure which extends downwardly from the opening in the roof through the attic of the building and opens up onto the ceiling of the room below the skylight. Some skylights have a translucent light difuser panel mounted in the ceiling at the bottom end of the light shaft and some are left open.

On a bright sunshiny day, the light admitted to a room through a skylight can be excessively intense and some prior art attempts have been made to provide solutions to the light intensity problem.

U.S. Pat. No. 1,888,522 discloses a plurality of juxtaposed opaque slats which are carried in a frame and are interconnected for ganged adjustment much in the manner of a venetian blind and a pull cord arrangement is provided for blind adjustment purposes. This venetian blind type of structure is mounted in the light shaft enclosing structure proximate the lower open end thereof and the pull cord hangs down through the open end into the room. As is the case with venetian blinds, and the special structure disclosed in this prior art patent, this type of blind will freely pass light when open, completely block the passage of light when fully closed, and can be adjusted to an intermediate position between fully opened and fully closed. When in such an intermediate position, some light will be blocked and some will freely pass through the openings between the juxtaposed opaque slats, and this passed light will be at full intensity. In addition to the lack of a light intensity reducing capability, i.e., dimming, the special blind structure disclosed in this patent is relatively complex and thus costly.

Another skylight blind structure of this same general type is commercially available. This blind is a pleated opaque shade which may be contracted and extended in the manner of a bellows or an accordion. The shade is formed of fabric which is bonded to aluminum and is carried for slidable movement in a frame that is mounted in the light shaft of the skylight. Due to the opaque nature of this accordion pleated blind, it lacks the capability of reducing light intensity of the admitted light when in an intermediate position and is relatively complex and thus costly as in the above described prior art patent. An extension rod having a special blind engaging end is needed to accomplish the sliding adjustment movements of this blind structure and the rod is used by placing it into the open bottom end of the light shaft into demountable engagement with the blind.

Both of the above described blind structures must be used in skylights of the type which are open on the bottom end of their light shafts. The pull cord arrangement hanging down from the above described venetian blind type of structure, and the need to provide open access for the extension rod used with the accordion pleated blind, precludes the use of these blinds in skylight structures having the ceiling mounted translucent light difuser panels, which is used in a great number of skylights.

To the best of my knowledge, no device has been provided or suggested which may be used in virtually any skylight and is capable of reducing the intensity of the light entering into a room through a skylight.

SUMMARY OF THE INVENTION

In accordance with the present invention, a relatively simple low cost light intensity reducing mechanism is provided for use in skylight structures to allow a user to select between full intensity and reduced intensity light passage through a skylight.

The light intensity reducing mechanism includes a translucent dimmer panel that is hingedly mounted in the light shaft enclosure of a skylight. A remotely operable drive means is provided to allow a user to selectively move the dimmer panel between a fully open position wherein full intensity light may pass through the skylight, and a closed position wherein reduced intensity light passes therethrough.

In a first embodiment, the remotely operable drive means includes a pull cord arrangement which is attached to the dimmer panel and extends from the light shaft enclosure of the skylight through the attic space of a building and downwardly through the ceiling into the room below the skylight at a convenient location in the room. The pull cord is essentially a two position control device having a released, or closed, position wherein the dimmer panel is resting on a suitable stop frame in a position substantially transverse to the light shaft enclosure of the skylight so as to admit reduced intensity light into the room. The other position of the pull cord arrangement is referred to as the pulled, or open, position wherein the dimmer panel is hingedly moved to a position wherein it lies in a substantially flat position relative to one of the interior sides of the light shaft enclosure, and is thereby open to allow the passage of full intensity light through the skylight.

In a second embodiment, a dimmer panel is mounted on an axle shaft which is journaled for rotation in the light shaft enclosure with the axle shaft being connected to a remotely operable drive means that is located on the exterior of the light shaft enclosure of the skylight. This drive means is a two position device and the axle shaft is driven to rotatably move the dimmer panel between its open full intensity light admitting position and its closed reduced intensity light admitting position. The drive means may be any suitable device that can be remotely operable to rotatably move the axle shaft, such as an electric motor or a crank-driven mechanical linkage.

In addition to providing a selective light intensity reducing capability, the mechanism of the present invention can be employed to enhance the aesthetic of the room below. The translucent dimmer panel can be formed of a colored glass or plastic sheet with the color being selected to complement the decor of the room. The dimmer panel may also be in the form of a stained glass panel to provide a multi-color effect.

Accordingly, it is an object of the present invention to provide a new and useful skylight structure having a remotely operable light intensity reducing mechanism which is inexpensive to fabricate and simple to install and operate.

Another object of the present invention is to provide a new and useful skylight structure having a light intensity reducing mechanism which includes a translucent dimmer panel that is mounted in the light shaft enclosure of the skylight for movement between an open full intensity light admitting position and a closed reduced intensity light admitting position.

Another object of the present invention is to provide a new and useful skylight structure of the above described character wherein the light intensity reducing mechanism includes a drive means that is located exteriorly of the light shaft of the skylight to allow the light intensity reducing mechanism to be used with virtually any standard type of skylight structure and to allow the operation of the mechanism to be accomplished from various desired remote locations.

The foregoing and other objects of the present invention as well as the invention itself, may be more fully understood from the following description when read in conjunction with the accompanying drawings.

BRIEF DESCRIPTION OF THE DRAWINGS

FIG. 1 is a fragmentary sectional view taken on a vertical plane through a skylight structure which is installed in a building, with the skylight being provided with a first embodiment of the remotely operable light intensity reducing mechanism.

FIG. 2 is an enlarged sectional view taken along the line 2—2 of FIG. 1.

FIG. 3 is an enlarged fragmentary sectional view taken along the line 3—3 of FIG. 2.

FIG. 4 is an enlarged sectional view taken along the line 4—4 of FIG. 1.

FIG. 5 is a fragmentary sectional view similar to FIG. 1 showing a skylight structure that is provided with a second embodiment of the remotely operable light intensity reducing mechanism.

FIG. 6 is a sectional view taken along the line 6—6 of FIG. 5.

FIG. 7 is an enlarged fragmentary sectional view taken along the line 7—7 of FIG. 6.

FIG. 8 is a fragmentary view similar to FIG. 6 and showing a modification of this second embodiment of the present invention.

DESCRIPTION OF THE PREFERRED EMBODIMENTS

Referring more particularly to the drawings, FIG. 1 shows a typical skylight structure which is identified in its entirety by the reference numeral 10. The skylight structure 10 includes, as is customary and well known in the art, a light admitting window 12 which is carried in a frame 13 that is mounted on the roof 14 of a building over an opening 15 formed through the roof. The skylight structure further includes an open ended light shaft enclosure 16 that extends from the opening 15 of the roof 14 down through the attic 17 of the building and communicates with an opening 18 provided in the ceiling 20. The light shaft enclosure 16 is normally formed of conventional construction materials such as a wooden framework 22 to which wall panels are affixed to provide the enclosure with sidewalls 23, 24, 25 and 26. Some skylight installations are left open at the lower end of the light shaft enclosure 16, i.e., the ceiling opening 18 is uncovered. Other skylight installations includes a light difuser panel assembly 28 that is mounted on the lower surface of the ceiling 20 to close the opening in the manner shown in FIG. 1.

As is known, skylight structures will vary in size and other structural details and it is to be understood that the skylight structure 10 installed and described herein is intended to be typical of such structures.

The skylight 10 is provided with a first embodiment of a remotely operable light intensity reducing mechanism which is indicated generally by the reference numeral 30. That mechanism 30 includes a dimmer panel 32 which is mounted within the light shaft enclosure 16. The dimmer panel 32 may be formed of a sheet of any translucent material, such as frosted glass, or any of the various types of translucent plastics, such as colored plexiglass and the like. The translucent sheet 34 may be supportingly carried in a suitable frame 36 in the well known manner seen best in FIG. 3. The dimmer panel 32 is mounted in the light shaft enclosure 16 by means of hinges 37 which are suitably attached to the sidewall 23 of the enclosure 16 and to the hinge edge 38 of the dimmer panel 32. The dimmer panel 32 is mounted directly above a stop frame 40 that is mounted on the inwardly facing surfaces of the sidewalls 23, 24, 25 and 26 in any suitable manner.

The light intensity reducing mechanism 30 further includes a remotely operable drive means 42 for hingedly moving the dimmer panel 32 about an axis of rotation defined by the hinges 37 between its closed light intensity reducing position shown in solid lines in FIG. 1 and its open full intensity light admitting position shown in dashed lines in that same figure. In the closed position, the dimmer panel 32 is in resting engagement on the stop frame 40 and is thus disposed in a position transverse to the light shaft enclosure 16. When hingedly moved to the open position, through approximately 90° of rotation about the hinge axis, it will be disposed in a position of being substantially parallel with the sidewall 23 of the light shaft enclosure 16.

The drive means 42 includes a pull cord 44 which is attached to the free side 46 of the dimmer panel 32 such as by means of the illustrated screw eye 47, or other suitable fasteners. The pull cord 44 extends upwardly from its attaching fastener 47 and passes through a guide bushing 48 which is mounted in the sidewall 23 of the light shaft enclosure 16 above the dimmer panel 32. The pull cord has an intermediate portion which exits the enclosure 16 and passes through the attic 17 of the building and through another guide bushing 50 mounted in the ceiling 20. The pull cord 44 depends from the guide bushing 50 into the room below the skylight structure 10 proximate a wall 52 of that room. A suitable pull handle 54 is affixed on the depending end of the pull cord 44 and at least one latching bracket 56 is attached to the wall 52 to hold the cord 44 in the downwardly pulled position wherein the dimmer panel 32 is open. A second latching bracket 58 may be provided for holding the pull cord 44 in its up position. As shown in FIG. 4, the latching brackets 56 and 58 may be simple bifurcated structures, or any other suitable device under which the pull handle 54 is holdingly placeable.

Although the pull cord type of control means 42 is shown and described as being configured to move and hold the dimmer panel 32 in two positions, i.e., fully open and fully closed, the addition of one or more latching brackets (not shown) similar to brackets 56 and 58, will change this light intensity reducing mechanism 30 into a multi-position device. As an alternative to the use of multiple latching brackets to provide this multi-position capability, a simple cleat (not shown) could be employed.

Reference is now made to FIGS. 5, 6 and 7 wherein a second embodiment of the remotely operable light intensity reducing mechanism 60 is shown as being installed in the skylight structure 10.

As seen best in FIG. 7, this light intensity reducing mechanism 60 includes a dimmer panel 62 which is in the form of a rigid self-supporting sheet 64 of translucent material, such as that hereinbefore described. A clamp means 66 is attached to one edge of the translucent sheet 64, such as by means of the fasteners 67, and the clamp means 66 is employed to fixedly attach the sheet 64 to an axle shaft 68. The axle shaft extends oppositely through the openings provided in the opposed sidewalls 24 and 26 of the light shaft enclosure 16 and is rotatably journaled in bearings 70 and 71 that are mounted the exterior surfaces of those sidewalls.

Therefore, rotation of the axle shaft 68 will rotatably move the dimmer panel 62 about the axis of rotation defined by the axle shaft between its closed position as shown in solid lines in FIG. 5 and its open position shown in dashed lines in the same figure. In the closed position, the dimmer panel 62 is in engagement with a suitable stop frame 72 that is mounted below the dimmer panel in the light shaft enclosure.

A remotely operable drive means, which is identified in its entirety by the reference numberal 74, is provided exteriorly of the light shaft enclosure 16, for rotatably driving the axle shaft 68, and thereby moving the dimmer panel 62 in the manner discussed above. A spur bevel gear 76 is fixedly carried on the extending end 77 of the axle shaft 68 and a matching spur bevel gear 78 is carried on the upper end of a drive shaft 80 so that the two gears 76 and 78 are in meshing engagement. The drive shaft 80 is rotatably journaled in suitable pillow blocks 82 that are carried on the sidewall 26 of the light shaft enclosure 16. The lower end of the drive shaft 80 has a socket 84 mounted thereon so as to be disposed in a suitable opening provided in the ceiling 20. A suitable extension tool, such as the illustrated crank 86, having a socket engaging end 87, may be used by an operator to selectively position the dimmer panel 62.

In addition to the right angle gear drive system described above, the drive means 74 further includes a counterweight mechanism 90. The counterweight 90 includes a shaft 92 which is connected to the end 77 of the axle shaft 68, with a weight means 94 being carried on the extending end of the counterweight shaft 92.

FIG. 8 shows a modified form of drive means 96 for use in this second embodiment of the remotely operable light intensity reducing mechanism. In this modification, a spur bevel gear 98 is fixed on the extending end 77 of the axle shaft 68 and a matching gear 100 is mounted on the output shaft of a reduction gear box 102 that is driven by a suitable electric motor 104. The motor 104 may be remotely actuated from any convenient location by providing a switch (not shown) in the power supply line.

From the above, it will now be apparent that the various embodiments of the remotely operable light intensity reducing mechanism of the present invention, are relatively low cost mechanisms which may be installed in virtually any skylight structure to allow a user to selectively reduce the intensity of the light passing through the skylight.

As hereinbefore mentioned, the translucent sheets 34 and 64 of the dimmer panels 32 and 62, respectively, may be formed of a sheet of any suitable translucent material. Therefore, by selective use of a particular translucent material, the aesthetics of the room below the skylight structure can be enhanced to achieve a desired lighting effect. For example, the use of a monocolored translucent plastic sheet can produce a lighting effect which complements the furnishings and decor of a room. And, a multi-color lighting effect can be achieved by using a stained glass translucent panel.

While the principles of the invention have now been made clear in the illustrated embodiments, there will be immediately obvious to those skilled in the art, many modifications of structure, arrangements, proportions, the elements, materials and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A light intensity reducing mechanism for use with a skylight structure of the type having a light shaft enclosure extending between a light admitting window mounted in a roof of a building and an opening formed in a ceiling of a room in the building, said light intensity reducing mechanism comprising:

(a) a sheet of translucent material for mounting in the light shaft enclosure of the skylight;

(b) an axle shaft defining an axis of rotation;

(c) means interconnecting said axle shaft and said sheet of translucent material;

(d) bearing means for rotatably journaling said axle shaft in the light shaft enclosure of the skylight for movement of said sheet of translucent material about the axis of rotation between a first full light passing position and a second reduced intensity light passing position;

(e) said axle shaft having one end which extends through the light shaft enclosure when installed therein;

(f) a drive shaft for rotatable mounting on the exterior of the light shaft enclosure, said drive shaft having one end proximate said axle shaft but its opposite end located in an opening defined by a ceiling in a building in which the skylight is mounted when said drive shaft is mounted on the light shaft enclosure;

(g) gear drive means mounted on said axle shaft and on said drive shaft for coupling said axle shaft to said drive shaft;

(h) coupling means on the opposite end of said drive shaft; and (i) tool means selectively connectable to said coupling means for rotatable driving of said drive shaft.

2. A light intensity reducing mechanism as claimed in claim 1 and further comprising a counterbalancing mechanism on said axle shaft for counterbalancing the weight of said dimmer panel.

3. A light intensity reducing mechanism as claimed in claim 1 wherein said sheet of translucent material is substantially rigid and self-supporting.

4. A light intensity reducing mechanism as claimed in claim 1 wherein said sheet of translucent material is supportingly carried in a frame.

5. A light intensity reducing mechanism as claimed in claim 1 wherein said sheet of translucent material is mono-colored to produce an aesthetically appealing lighting effect when said translucent dimmer panel is in the second position thereof.

6. A light intensity reducing mechanism as claimed in claim 1 wherein said sheet of translucent material is multi-colored to produce an aesthetically appealing lighting effect when said translucent dimmer panel is in the second position thereof.

7. A light intensity reducing mechanism for use with a skylight structure of the type having a light shaft enclosure extending between a light admitting window mounted in a roof of a building and an opening formed in a ceiling of a room in the building, said light intensity reducing mechanism comprising:

(a) a sheet of translucent material for mounting in the light shaft enclosure of the skylight;

(b) an axle shaft defining an axis of rotation;

(c) means interconnecting said axle shaft and said sheet of translucent material;

(d) bearing means for rotatably journaling said axle shaft in the light shaft enclosure of the skylight for movement of said sheet of translucent material about the axis of rotation between a first full light passing position and a second reduced intensity light passing position;

(e) said axle shaft having one end which extends through the light shaft enclosure when mounted therein;

(f) a remotely actuatable electric motor for mounting on the exterior of the light shaft enclosure; and (g) gear means for interconnecting the one end of said axle and said electric motor.

8. A light intensity reducing mechanism as claimed in claim 7 wherein said sheet of translucent material is substantially rigid and self-supporting.

9. A light intensity reducing mechanism as claimed in claim 7 wherein said sheet of translucent material is supportingly carried in a frame.

10. A light intensity reducing mechanism as claimed in claim 7 wherein said sheet of translucent material is mono-colored to produce an aesthetically appealing lighting effect when said translucent dimmer panel is in the second position thereof.

11. A light intensity reducing mechanism as claimed in claim 7 wherein said sheet of translucent material is multi-colored to produce an aesthetically appealing lighting effect when said translucent dimmer panel is in the second position thereof.

12. A skylight structure with a light intensity reducing mechanism comprising in combination:

(a) a light admitting window for mounting in the roof of a building having a ceiling in downwardly spaced relationship with the roof;

(b) an opaque light shaft enclosure in depending light receiving engagement with said window and having an open bottom end for mounting in light delivering engagement with an opening provided in the ceiling of the building, said enclosure defining a light transmission path between said window and its bottom end;

(c) a translucent dimmer panel in said enclosure proximate the bottom end thereof, said panel having opposed side edges;

(d) mounting means in said enclosure proximate the bottom end thereof and connected to one of the side edges of said panel, said mounting means defining an axis of rotation about which said panel is movable; and (e) a pull cord having one end attached to the other side edge of said panel and extending upwardly therefrom in said enclosure and exiting therefrom at a point above said mounting means, said pull cord being passable downwardly through the ceiling of the building to locate its other end below the ceiling, said pull cord being operable to selectively move said panel about the axis of rotation of said mounting means between a full intensity light passing position wherein said panel extends upwardly from said mounting means in substantially coextensive relationship with the light transmission path defined by said enclosure and a second reduced light intensity passing position wherein said panel is substantially transverse with respect to the light transmission path defined by said enclosure.

13. A skylight as claimed in claim 12 wherein said translucent dimmer panel includes a sheet of translucent material which is substantially rigid and self-supporting.

14. A skylight as claimed in claim 12 wherein said translucent dimmer panel includes a sheet of translucent material which is supportingly carried in a frame.

15. A skylight as claimed in claim 12 wherein said translucent dimmer panel includes a sheet of mono-colored translucent material.

16. A skylight as claimed in claim 12 wherein said translucent dimmer panel includes a sheet of multi-colored translucent material.

* * * * *